United States Patent [19]

Krauth et al.

[11] 4,298,059

[45] Nov. 3, 1981

[54] HEAT EXCHANGER AND PROCESS FOR ITS MANUFACTURE

[75] Inventors: Axel Krauth; Horst R. Maier; Hans-Juergen Phlmann, all of Selb; Siegfried Foerster, Alsdorf; Manfred Kleeman, Quadrath, all of Fed. Rep. of Germany

[73] Assignees: Rosenthal Technik AG, Selb; Kernforschungsanlage Juelich GmbH, Juelich, both of Fed. Rep. of Germany

[21] Appl. No.: 77,893

[22] Filed: Sep. 24, 1979

[30] Foreign Application Priority Data

Sep. 23, 1978 [DE] Fed. Rep. of Germany ..... 7828445

[51] Int. Cl.[3] ..... F28F 3/00

[52] U.S. Cl. ..... 165/166; 165/170

[58] Field of Search ..... 165/166, 165, 170; 29/157.3 D; 113/118 C, 118 D

[56] References Cited

U.S. PATENT DOCUMENTS

| | | | |
|---|---|---|---|
| 1,833,166 | 11/1931 | Lucke | 165/166 |
| 1,833,666 | 11/1931 | Watson et al. | 165/166 |
| 2,184,759 | 12/1939 | Shipman | 165/166 |
| 2,303,157 | 11/1942 | Bush | 165/166 |
| 3,454,082 | 7/1969 | Harke | 165/166 |
| 3,733,244 | 5/1973 | Sanberger et al. | 165/166 |
| 3,734,177 | 5/1973 | Bellovary | 165/166 |
| 3,814,172 | 6/1974 | Shore | 165/166 |
| 3,945,434 | 3/1976 | Parker | 165/166 |
| 4,041,591 | 8/1977 | Noll et al. | 165/165 |
| 4,041,592 | 8/1977 | Kelm | 165/166 |
| 4,099,928 | 7/1978 | Norback | 165/166 |
| 4,134,195 | 1/1979 | Jacobsen et al. | 165/166 |
| 4,183,403 | 1/1980 | Nicholson | 165/170 |

*Primary Examiner*—Daniel J. O'Connor

*Attorney, Agent, or Firm*—Schwartz, Jeffery, Schwaab, Mack, Blumenthal & Koch

[57] ABSTRACT

Disclosed is a recuperative heat exchanger, comprising a body of ceramic material having a plurality of generally parallel flow channels arranged adjacently to one another generally axially with respect to the body, with adjacent flow channels having a common partition wall. The plurality of flow channels include a plurality of first flow channels for carrying a first heat transfer medium and a plurality of second flow channels, alternatingly arranged with respect to the first flow channels, for carrying a second heat exchange medium. Each of the first channels has an inlet positioned on one lateral side of the body near a first longitudinal end of the body and an outlet positioned in the opposite, second longitudinal end of the body, and each of the second flow channels has an inlet positioned on one lateral side of the body near the second longitudinal end of the body and an outlet in the first longitudinal end of the body. Also disclosed are several processes for manufacturing the disclosed heat exchangers.

5 Claims, 10 Drawing Figures

HEAT EXCHANGER AND PROCESS FOR ITS MANUFACTURE

BACKGROUND OF THE INVENTION

The present invention relates to a recuperative heat exchanger, and more especially to a recuperative heat exchanger made of a ceramic material and having a plurality of flow channels which are arranged in a row adjacent to each other and which are directed parallel with respect to each other. The heat exchanger includes inlet and outlet orifices for media in heat exchange relationship. Adjacent flow channels have a common partition wall, with different media engaged in the exchange of heat flowing through adjacent flow channels, and the flow channels are offset alternatingly with respect to each other in the direction of the inlet orifice. The present invention also relates to a process for manufacturing such recuperative heat exchangers.

Recuperative heat exchangers of this type are especially suitable for gas turbines, in which case ceramic materials, such as silicon carbide SiC, silicon nitride $Si_3N_4$ and cordierite, are used. Such a heat exchanger has already been proposed in DE-OS No. 27 07 290; it comprises a U-shaped medium conduit. Furthermore, in DE-OS No. 24 53 961 there is described a recuperative heat exchanger, especially for gas turbines, having preferably cross-shaped or Z-shaped medium conduits made of metal or ceramics. Similarly, a tubular plate heat exchanger with L-shaped medium conduits made of metal is known from U.S. Pat. No. 2,430,270. The latter heat exchanger is used particularly for heating of air or liquids, wherein hot combustion gases are used as the heating medium. The heat exchanger is of simple design and is readily disassembled for cleaning purposes. However, such a heat exchanger is not suitable for high temperature applications.

Especially in the automotive industry, heat exchangers capable of resisting gas temperatures of approximately 1300° C. are needed for the development of economical vehicle gas turbine engines. For this reason, only ceramic materials come under consideration as heat exchange materials for this use. Furthermore, the problems attendant this use could not be solved entirely with regenerator heat exchangers with their rotating ceramic disks, so that resort is now being made to the recuperator type. Heat exchangers suitable for this or other applications should have a high degree of efficiency, small dimensions and a light weight. It is required furthermore that such ceramic recuperative heat exchangers operate reliably and that they may be manufactured inexpensively.

SUMMARY OF THE INVENTION

It is therefore an object of the present invention to provide an improved ceramic recuperative heat exchanger.

It is a further object of the invention to provide such a ceramic heat exchanger which may be equipped in a simple manner with connections for the media engaged in the exchange of heat.

Another object of the invention resides in the provision of a ceramic recuperative heat exchanger which can be manufactured at the lowest possible production cost.

Still another object of the invention is to provide an improved method of manufacturing a ceramic recuperative heat exchanger.

In accomplishing the foregoing objects, there has been provided in accordance with one aspect of the present invention a recuperative heat exchanger, comprising a body of ceramic material having a plurality of generally parallel flow channels arranged adjacently to one another generally axially with respect to the body, with adjacent flow channels having a common partition wall. The plurality of flow channels includes a plurality of first flow channels for carrying a first heat transfer medium and a plurality of second flow channels, alternatingly arranged with respect to the first flow channels, for carrying a second heat exchange medium, with each of the first flow channels having an inlet positioned on one lateral side of the body near a first longitudinal end of the body and an outlet positioned in the opposite, second longitudinal end of said body, and with each of the second flow channels having an inlet positioned on one lateral side of the body near the second longitudinal end of the body and an outlet in the first longitudinal end of the body.

In accordance with another aspect of the present invention, there has been provided a process for producing a recuperative heat exchanger comprising the steps of: providing a generally rectangular block of ceramic material-forming a plurality of spaced generally parallel first flow channels generally axially in a first side of the block, these first flow channels extending from a first longitudinal end of the block to a point short of the opposite, second longitudinal end of the block, whereby the second end remains closed; applying a first cover plate over the first side of the block, the first cover plate having an aperture communicating with the ends of the first flow channels adjacent the second end of the block; forming a plurality of spaced generally parallel second flow channels in a second side of the block opposite the first side, these second flow channels being located in the regions between the first flow channels and extending from the second end to at least a point close to the first end of the block, and these second flow channels being formed completely through the block and the first cover plate in a region adjacent the first end of the block; and applying a second cover plate over the second side of said block. In a preferred embodiment, the second flow channels extend from the second end to the first end of the block and the process further comprises the step of closing off the second flow channels at the first end of the block.

In accordance with a further aspect of the invention, there has been provided a process for producing a recuperative heat exchanger comprising the steps of: extruding a block of ceramic material from a die orifice containing a plurality of first and second cores to define a plurality of first and second generally rectangular cross-section flow channels arranged generally parallel and adjacently to one another along the axis of extrusion, the first and second flow channels being arranged in alternating relationship, with the first flow channels being wider in cross-sectional dimension than the second flow channels and the second flow channels being longer in cross-sectional dimension than the first flow channels; cutting the block to the desired longitudinal size; forming a first aperture in a first lateral side of the block near a first end of the block, this aperture being formed only to a depth sufficient to communicate with the second flow channels; forming a plurality of second apertures in a second lateral side of the block at the opposite, second end of the block, these second apertures being formed only in the regions adjacent to the first flow channels to communicate with the first flow channels; closing the first flow channels at the second end of the block; and closing the second flow channels at the first end of the block.

According to still another aspect of the invention, there has been provided a process for producing a recuperative heat exchanger comprising the steps of: providing a plurality of generally rectangular sheets of ceramic material; laminating these sheets alternatingly with first and second generally rectangular spacer-strips placed along the longer-dimension sides of the sheets to define a block having a plurality of first and second parallel flow channels, the first spacer-strips being both wider and longer cross-sectionally than the second spacer-strips, whereby the first flow channels are wider and shorter in cross-sectional dimension than the second flow channels; forming a first aperture in a first laterial side of the block near a first end of the block, this aperture being formed only to a depth sufficient to communicate with the second flow channels; forming a plurality of second apertures in a second lateral side of the block at the opposite, second end of the block, these second apertures being formed only in the regions adjacent to the first flow channels to communicate with the first flow channels; closing the first flow channels at the second end of the block; and closing the second flow channels at the first end of the block. The laminated block is thereafter sintered.

Further objects, features and advantages of the present invention will become apparent from the following detailed description of preferred embodiments, when considered in light of the attached figures of drawing.

BRIEF DESCRIPTIION OF THE DRAWINGS

DETAILED DESCRIPTION OF PREFERRED EMBODIMENTS

According to the invention, the orifices of adjacent flow channels extending to the lateral side of the heat exchanger are placed, respectively, in the region of the opposing longitudinal ends of the device, and the other end of each flow channel is open at the end opposite from the laterally extending orifice thereof.

Variations with respect to the orifices on the outlet covering walls are described hereinafter. Furthermore, at least the flow channels which are under low pressure may be provided with shoring supports. Sawing, extrusion and sheeting techniques are suitable for the manufacture of ceramic heat exchangers according to the invention having L-shaped medium conduits.

The construction of a number of embodiments of the ceramic heat exchangers having L-shaped medium conduits according to the invention, as well as several processes for the manufacture of such heat exchangers, will be explained in more detail with reference to the figures of drawing.

Figure 1:
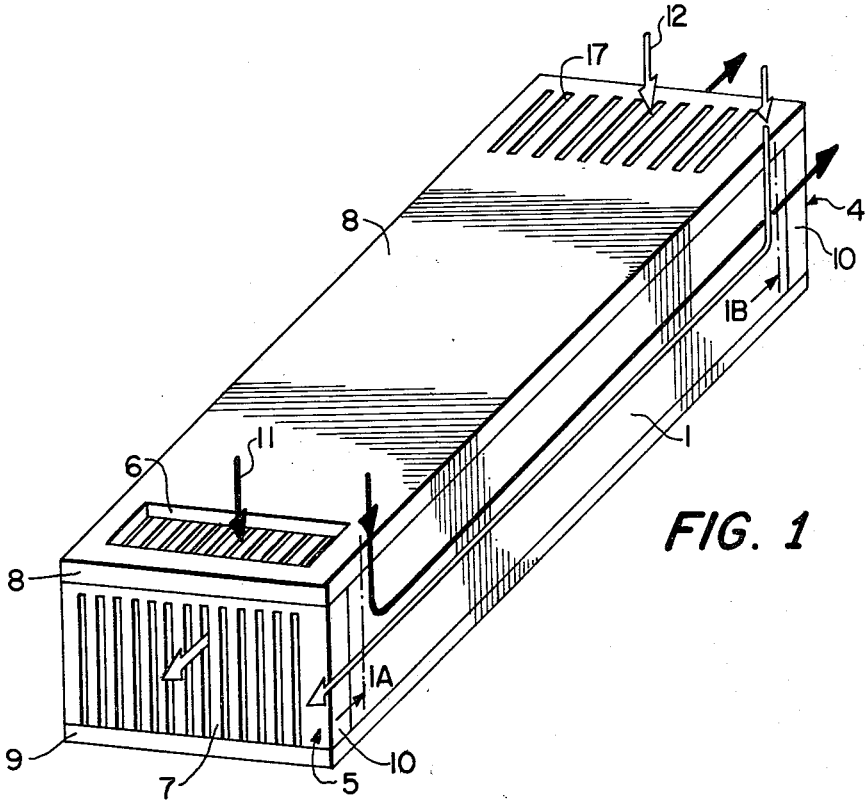
FIG. 1 is a perspective view of one embodiment of a heat exchanger according to the present invention.
Figure 1A:
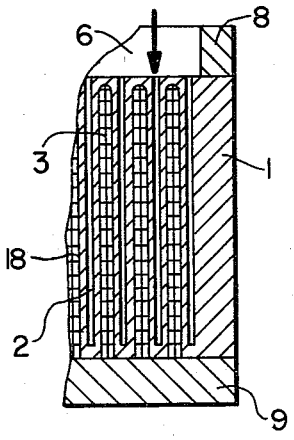
FIG. 1A is a partial cross-sectional view taken along the line A—A in FIG. 1.
Figure 1B:
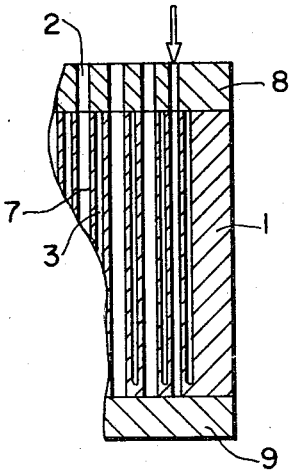
FIG. 1B is a partial cross-sectional view taken along the line B—B in FIG. 1.

In FIGS. 1, 1A and 1B, the L-shaped medium conduit is shown in a heat exchanger block 1. In its construction, the recuperative heat exchanger displays parallel flow channels 2, 3 arranged adjacently to each other, wherein the adjacent flow channels have a common partition wall 7. Concerning the dimensions of the flow channels, a slit width of 0.8 mm for the high pressure side 2, and a slit width of 1.6 mm for the low pressure side 3 have proven to be favorable. Additionally, the flow channels 3 of the low pressure side may be reinforced by means of supports 18. As a result of these supports, and also because of the multiple reductions in cross section, increased flow velocities and vortex formations are obtained, leading to an effective increase in the rate of heat exchange. Further parts consist of the cover walls 8, 9 and the comb-like end pieces 10, which together form the structural elements proper of the heat exchanger. Further, the open front ends 4, 5 are closed off with the comb-like terminal pieces 10 so that the flow channels 2, 3 form an L-shaped medium conduit. By means of connections with the orifices 11 and 12, gases or liquids are admitted in the manner indicated by the directional arrows, whereby heat exchange according to the counter current principle is effected. The inlet orifices 11 and 12 may be located either on one side, or on opposite sides of the cover walls 8, 9.

Basically, the individual parts of the single pass heat exchanger may advantageously be made of ceramic masses of silicon nitride, silicon carbide and cordierite, which in the fired condition exhibit a high thermal stability to temperatures of 1300° C. and higher and which are also characterized by good resistance to thermal shock. This higher temperature resistance, in particular, opens up possible applications not feasible with metallic heat exchangers. On the other hand, ceramic materials do not permit, without special measures, the finely detailed design of recuperators possible with metals. For this reason, the individual manufacturing stages and calibrations must be coordinated one after another so that optimum production both from a technical and economical standpoint is achieved.

Figure 2:
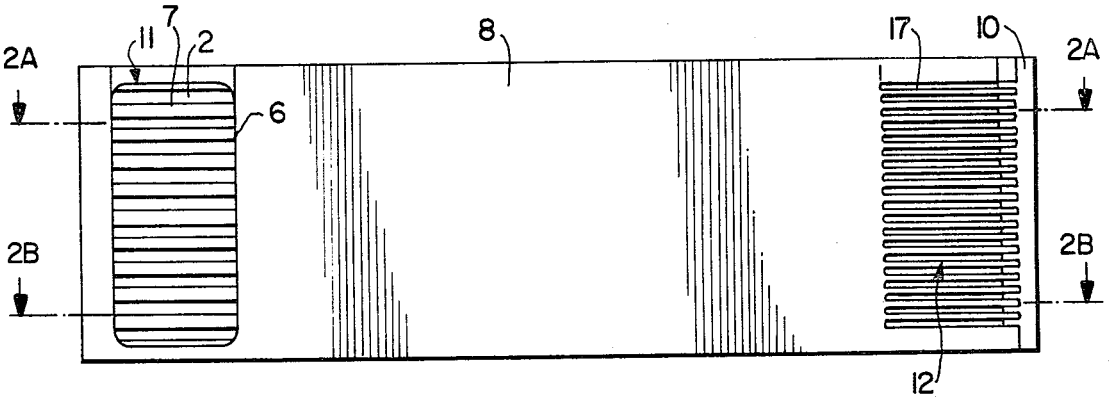
FIG. 2 is a top view of a heat exchanger according to the invention, manufactured by the sawing method.
Figure 2A:
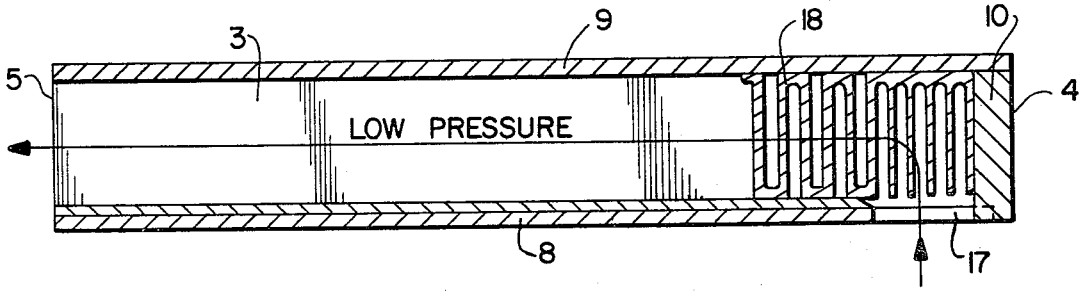
FIG. 2A is a cross-sectional view taken along the line A—A in FIG. 2.
Figure 2B:
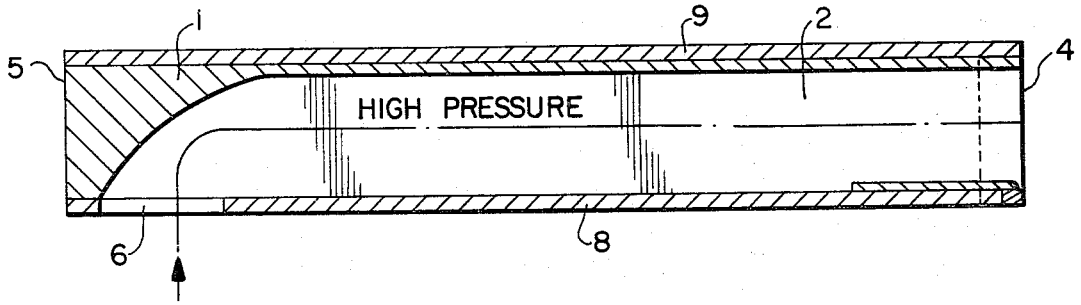
FIG. 2B is a cross-sectional view taken along the line B—B in FIG. 2.

The heat exchanger according to FIGS. 2, 2A and 2B is made by means of a sawing technique, wherein silicon nitride is a particularly suitable material. The initial shape is an isostatically pressed and pre-nitrided block. From the side of the subsequently supplied cover wall 8, flow channels, 2 are cut into the block by means of diamond cutting wheels, so that the front end 5 at first remains closed. In order to obtain slit widths as constant as possible and to prevent the breakage of partition walls 7, the grinding dust is blown out immediately with a compressed air nozzle, close to the grinding location. This also provides additional cooling, thus reducing thermal stresses in the cutting wheel. Both the individual cover walls 8, 9 and the block 1 are previously ground to be plane-parallel in shape. A recess is additionally machined into the cover wall 8, which serves as the inlet orifice 11 in the form of a window 6 for the high pressure medium. Subsequently, the cover wall 8 is mounted so that the window 6 is located at the frond end 5, which is still closed. The body is then placed, with the cover side 8 down, on the cutting machine, and the opposite side is provided with continuous flow channels 3 for the low pressure side. In this procedure, the cutting blades are lowered at the end of the front end 4 so that the slits 17 for the low pressure side are formed in the cover wall 8. If necessary, the supports 18 are introduced from this end into the flow channels 2. Subsequently, the flow channels 3 are closed off on the front end 4 with a terminal piece 10, so that on this end only the flow channels 2 remain open. The last assembly step consists of mounting the closed cover wall 9. The heat exchanger manufactured in this manner is finish-nitrited at a temperature between about 1350° C. and 1500° C.

Figure 3:
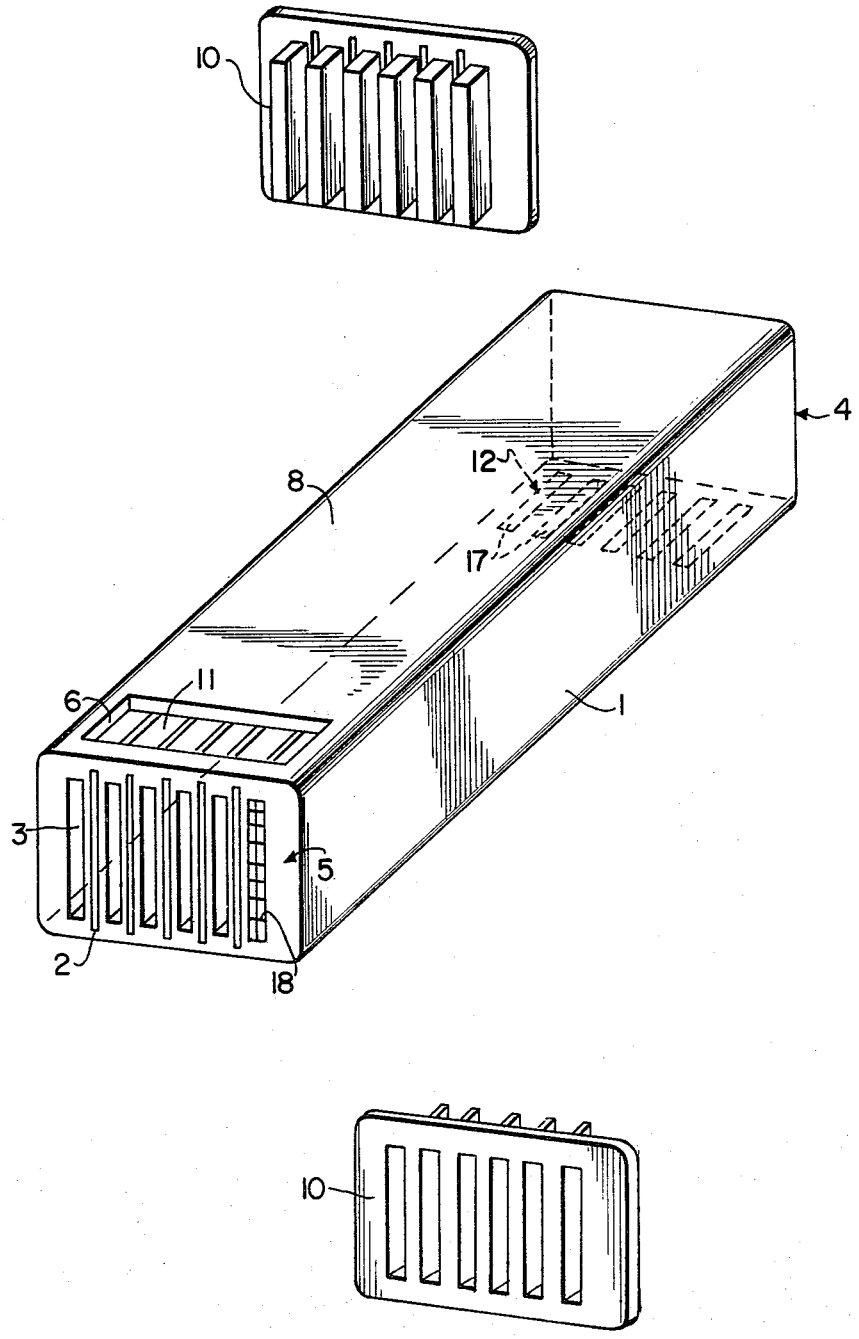
FIG. 3 is an exploded perspective view of a heat exchanger according to the invention made by the extrusion method.

The single pass ceramic heat exchanger according to the invention illustrated in FIG. 3 is made by the extrusion technique. The specific configuration of the flow channels is obtained by the use of appropriate cores in the nozzle of the vacuum press. For example, the nozzle may be designed so that wide flow channels 3 and somewhat longer and thinner flow channels 2 are formed. The extruded piece is then cut to the corresponding length of the heat exchanger block 1. The inlet orifice 11 for the high pressure side is obtained by opening up the flow channels 2 through the cover wall 8 in the form of a window 6. The opening of the flow channels 3 for the low pressure side on the cover wall 8 is effected by milling slits 17 in the direction of the flow channels 3 in the vicinity of the end side 4. Finally, the comb-like terminal pieces 10 are mounted on the two front ends 4, 5, said terminal pieces being shaped so that an L-shaped medium conduit is obtained. Thereafter, the thus-produced heat exchanger is subjected to the sintering process.

Figure 4:
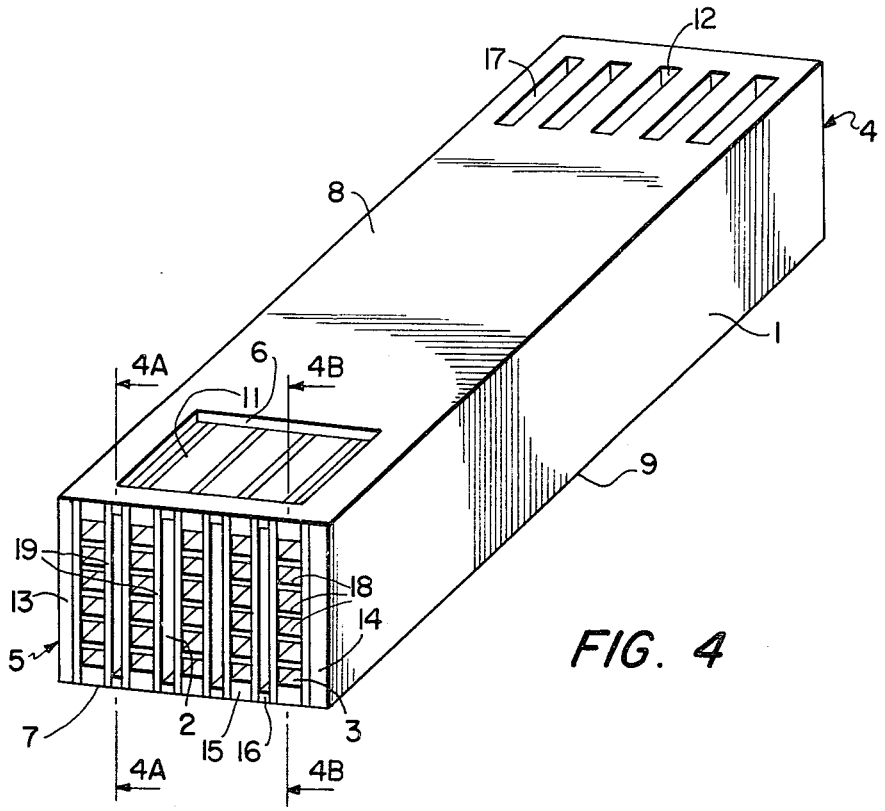
FIG. 4 is a perspective view of a heat exchanger according to the invention produced by the sheeting technique.
Figure 4A:
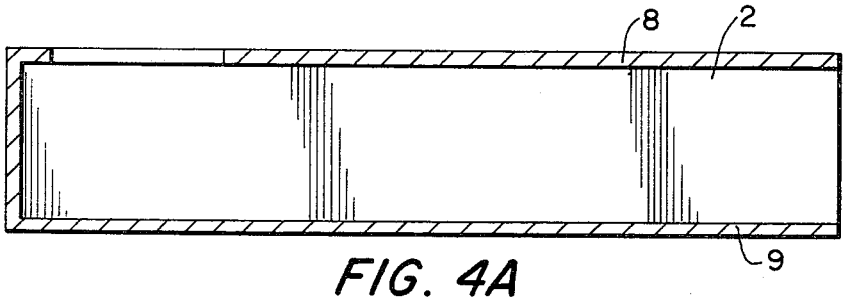
FIG. 4A is a cross-sectional view taken along the line A—A in FIG. 4.
Figure 4B:
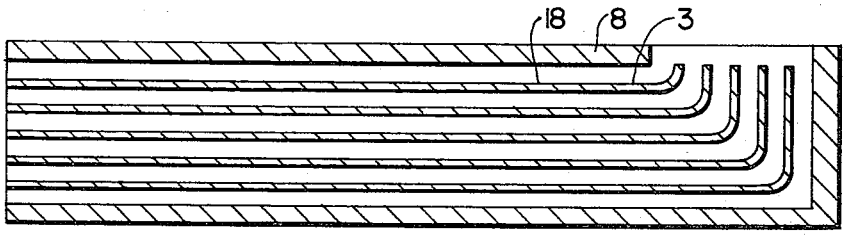
FIG. 4B is a cross-sectional view taken along the line B—B in FIG. 4.

The block like heat exchanger 1 according to the invention may also be produced from individual rectangular or square sheets, as shown in FIG. 4. The heat exchanger block is obtained, for example, by placing stamped out sheets 19 on thicker 15 and thinner 16 spacers and enclosing the stack laterally by means of the two base plates 13 and 14. The external edges of the spacers 15, 16 and of the sheets 19 form the cover walls 8 and 9. The spacers 15 and 16 are either extruded or isostatically pressed. From a manufacturing standpoint, it is thus more favorable to mill the window 6, than to interrupt the spacers 15 and 16 in this area. The inlet orifice 12 for the low pressure side, with the wide slits 17, is obtained by interrupting the cover wall 8, at the spacers 16. The green strength of the heat exchanger block is obtained by exposing it to either a cold or a hot laminating process. In hot laminating, temperatures about 80° and 150° C. are reached and a moderate pressure of approximately 20 kg/cm$^2$ is applied to attain the adhesion of the individual parts. In cold laminating, on the other hand, the pressure must be considerably increased; it is between about 40 and 200 kg/cm$^2$, and the individual layers must first be provided with a synthetic resin coating in order to obtain the adhesive effect. Subsequently, the body is exposed to a conventional sintering process. Even though production costs are somewhat higher than in the extrusion process, there is the advantage that the constructed supports 18 may be introduced in the direction of the gas flow, as seen in FIG. 4B.

The manufacture of the ceramic heat exchangers according to the invention is not restricted to the above-described production methods, but a combined sawing and extruding technique may also be applied. Such production methods make feasible the economical and reliable manufacture of ceramic heat exchangers of this type. By means of the specific configuration of the inlet and outlet orifices, the heat exchanger may be connected, for example, directly with the line of a gas turbine, without the use of resilient, expansion-absorbing means. Furthermore, such heat exchangers may be produced economically because of the relatively inexpensive starting material.

What is claimed is:

1. A recupertive heat exchanger, comprising:

a body of ceramic material having longitudinal ends, outer walls and a plurality of generally parallel flow channels arranged adjacently to one another generally axially with respect to said body, said flow channels having longitudinal sides which extend axially with respect to said body and a pair of frontal sides disposed at the axial ends of said flow channels, certain of said longitudinal sides being located immediately adjacent said outer walls, each of said flow channels including orifices for the entry and exit of flow media, said orifices including an orifice in one specific frontal side of each flow channel and an orifice in one of said certain longitudinal sides thereof, said flow channels extending over the entire length of said body from one longitudinal end to the other, adjacent flow channels having a common partition wall, said plurality of flow channels including a plurality of first flow channels for carrying a first heat transfer medium and a plurality of second flow channels, alternatingly arranged with respect to said first flow channels, for carrying a second heat exchange medium, each of said flow channels extending over its entire length next to the channel which is directly adjacent to it, said first channels having an inlet positioned on one lateral side of said body near a first longitudinal end of said body and an outlet positioned in the opposite, second longitudinal end of said body, and said second flow channels having an inlet positioned on one lateral side of said body near said second longitudinal end of said body and an outlet in said first longitudinal end of said body, said flow channels also being closed at their frontal sides and along their longitudinal sides except for said orifices in said specific frontal sides of said flow channels and said orifices in said certain longitudinal sides thereof, said orifices in said certain longitudinal sides being inlet orifices at least partially defining said inlets, said orifices in said specific frontal sides being outlet orifices at least partially defining said outlets.

2. A recuperative heat exchanger as defined by claim 1, wherein the inlets of said first and said second flow channels are positioned on the same lateral side of said body.

3. A recuperative heat exchanger as defined by claim 1, wherein the inlets of said first flow channels are positioned on a first lateral side of said body and the inlets of said second flow channels are positioned on a second lateral side of said body opposite the said first lateral side.

4. A recuperative heat exchanger as defined by claim 1, 2 or 3, further comprising supporting members positioned inside of at least said first flow channels, wherein said first flow channels carry said first heat exchange medium at a lower pressure than said second heat exchange medium.

5. A recuperative heat exchanger as defined in claim 1, wherein said ceramic material of said body is silicon nitride.

* * * * *

UNITED STATES PATENT AND TRADEMARK OFFICE

CERTIFICATE OF CORRECTION

PATENT NO. : 4,298,059

DATED : November 3, 1981

INVENTOR(S) : KRAUTH, ET AL.

It is certified that error appears in the above—identified patent and that said Letters Patent is hereby corrected as shown below:

In the cover page, column 1, item 75 (Inventors), line 2, delete "Phlmann" and insert therefor -- Pohlmann --.

Signed and Sealed this

*Eleventh* Day of *May 1982*

[SEAL]

*Attest:*

GERALD J. MOSSINGHOFF

*Attesting Officer*

*Commissioner of Patents and Trademarks*